US005862794A

United States Patent [19]

Yoshioka

[11] Patent Number: 5,862,794

[45] Date of Patent: Jan. 26, 1999

[54] FUEL-INJECTION CONTROL DEVICE FOR OUTBOARD MOTORS

[75] Inventor: Hidehiko Yoshioka, Shizuoka-ken, Japan

[73] Assignee: Suzuki Motor Corporation, Japan

[21] Appl. No.: 816,660

[22] Filed: Mar. 13, 1997

[30] Foreign Application Priority Data

Mar. 26, 1996 [JP] Japan ..... 8-069768

[51] Int. Cl.[6] ..... F02D 41/04

[52] U.S. Cl. ..... 123/486; 123/494; 440/1

[58] Field of Search ..... 123/478, 480, 123/486, 494; 440/1

[56] References Cited

U.S. PATENT DOCUMENTS 4,814,992 3/1989 Sakurai et al. ..... 123/480

5,073,133 12/1991 Inoue ..... 440/1

5,626,120 5/1997 Akatsuka ..... 123/479

*Primary Examiner*—Andrew M. Dolinar

*Attorney, Agent, or Firm*—Morrison Law Firm

[57] ABSTRACT

In an outboard motor having a fuel-injected two-cycle engine, engine speed, throttle setting, engine temperature and/or other variables are detected and a basic fuel injection volume determined. Fuel is supplied to each of the engine's cylinders according to the detected values. When the engine is operating at a high speed, trim angle and vessel speed are detected. The trim angle and vessel speed are used to correct the basic fuel injection volume determined before high speed operation of the engine is detected.

10 Claims, 7 Drawing Sheets

CORRECTION MAP BASED ON TRIM ANGLE AND VESSEL SPEED

| | | TRIM ANGLE | | | | | |
|---|---|---|---|---|---|---|---|
| | | T1 | T2 | T3 | T4 | T5 | ... |
| VESSEL SPEED (V) | V1 | C11 | C12 | C13 | C14 | C15 | ... |
| | V2 | C21 | C22 | C23 | ... | ... | |
| | V3 | C31 | C32 | ... | | | |
| | V4 | C41 | ... | | | | |
| | | ... | | | | | |

FIG.7

FUEL-INJECTION CONTROL DEVICE FOR OUTBOARD MOTORS

BACKGROUND OF THE INVENTION

The present invention relates to a fuel-injection control device for outboard motors. More particularly, the invention relates to performance of such fuel-injection control devices during high-speed operation of a controlled engine.

Engines can use a carburetor as a means for supplying a fuel-and-air mixture to the cylinder of the engine. A carburetor positioned in the suction flow path of an engine takes advantage of the vacuum created when air is sucked in by the engine. The vacuum forces fuel to be drawn from a chamber through a jet to form a mist which mixes with air being drawn into the engine.

To compensate for the specific characteristics of the engine and the load (e.g., automobile) it drives, various different jet types can be used to provide an optimal setting. Previously, it has been impossible to have the carburetor adapt continuously to changes in driving conditions, surrounding environments, and the like. Particularly, the problem of achieving a proper setting for the air-to-fuel ratio when the engine is started is subtle and problematic.

Lately, engines employing fuel-injection have been widely used as an alternative to carburetors. A fuel-injection device can be controlled according to parameters such as the engine rotation speed, the throttle setting, the temperatures of the engine and the water used to cool the engine, and the air suction temperature. This data is processed by a computer to determine a correction value. The amount of fuel, injected directly into the suction path of the engine, can be made appropriate for the particular set of circumstances existing at any particular moment. Thus, combustion efficiency can be optimized continuously, maximizing engine output. Also, since only a minimum required quantity of fuel is injected, fuel consumption is minimized.

Referring to FIGS. 8(*a*) and 8(*b*), a conventional outboard motor M is mounted via an attachment bracket B on a vessel V. Outboard motor M pivots on the attachment bracket B permitting a trim angle θ to vary. The trim angle θ can be made appropriate for the speed of vessel V and the positioning of vessel V on the surface of water W. More particularly, trim angle θ can be increased when vessel speed is high and decreased when vessel speed is low. Thus, engine output can be maximized by adjusting the trim angle θ to maintain the propeller of outboard motor M in proper orientation with the surface of water W.

Generally, air sucked into an engine is expelled from the engine through an exhaust exit which permits the air to disperse into the surrounding atmosphere. As a result, the intake volume of air sucked into the engine can be calculated based on the throttle setting and the engine rotation speed. However, in outboard engines, the exhaust opening of the engine is underwater causing a back flow pressure of air to develop in the exhaust path. The back flow pressure in the exhaust path varies depending on the vessel speed and the trim angle. In a two-cycle outboard engine, changes in back flow pressure causes the intake volume to vary. As a result, the intake volume of air sucked into the engine cannot be accurately calculated based on the throttle setting and the engine rotation speed. When fuel injection is determined based on inaccurate calculations of intake volume the fuel consumption increases, the engine output decreases, and the exhaust gasses deteriorate.

In an attempt to reduce inaccurate calculations of intake volume, Japanese laid-open publication number 5-18287 discloses a method for detecting an exhaust pressure at an engine's exhaust port and calculating a correction value used to adjust the amount of fuel injected into the suction path of the engine. However, the high temperatures and pressures encountered at the exhaust port causes water and salt to adhere to the area surrounding the exhaust port. As a result, the exhaust pressure detecting means used in this method needs to be pressure-resistant, heat-resistant, water-resistant and salt-resistant. This increases production costs and decreases the reliability of the exhaust pressure detecting means.

OBJECT AND SUMMARY OF THE INVENTION

The object of the present invention is to overcome the problems of the prior art described above and to provide a fuel injection control device for outboard motors that can apply a correction to the fuel injection volume to achieve an optimal air-to-fuel ratio without detecting the exhaust pressure.

Briefly stated, the present invention provides an outboard motor having a fuel-injected two-cycle engine, wherein engine speed, throttle setting, engine temperature and/or other variables are detected and a basic fuel injection volume determined. Fuel is supplied to each of the engine's cylinders according to the detected values. When the engine is operating at a high speed, trim angle and vessel speed are detected. The trim angle and vessel speed are used to correct the basic fuel injection volume determined before high speed operation of the engine is detected.

According to an embodiment of the invention, there is provided a fuel injection control device for an outboard motor with a fuel-injected engine comprising: a control unit, an engine speed detector to detect an engine speed of the motor, the engine speed detector being connected to apply a first output reflecting the engine speed of the motor to the control unit, a trim angle detector to detect a trim angle of the motor, the trim angle detector being connected to apply a second output reflecting the trim angle to the control unit, a vessel speed detector to detect a speed of a vessel driven by the motor, the vessel speed detector being connected to apply a third output reflecting the speed of the vessel to the control unit, and the control unit being programmed to adjust a fuel injection volume flow rate supplied to the fuel-injected engine responsively to the first, second, and third outputs.

According to another embodiment of the invention, there is provided a fuel injection control device for an outboard motor with a fuel-injected engine comprising: a control unit, a first detector to detect a first operating variable of the motor, the first detector being connected to apply a first output reflecting the first operating variable of the motor to the control unit, a second detector to detect one of a speed of a vessel driven by the motor and a trim angle of the motor, the second detector being connected to apply a second output reflecting one of the vessel speed and the trim angle to the control unit, and the control unit being programmed to adjust a fuel injection volume flow rate supplied to the fuel-injected engine responsively to the first and the second outputs.

According to still another embodiment of the invention, there is provided a fuel injection control device for an outboard motor with a fuel-injected engine comprising: a control unit, a first detector to detect a first operating variable of the motor, the first detector being connected to apply a first output reflecting the first operating variable of the motor to the control unit, the control unit being programmed to calculate a basic fuel injection volume flow rate responsively to the first output, a second detector to detect a second operating variable of the motor, the second detector being connected to apply a second output reflecting the second operating variable of the motor to the control unit, and the control unit being programmed to calculate a corrected fuel injection volume flow rate from the basic fuel injection volume flow rate responsively to the second output when the first output reflects that the first operating variable is greater than a predetermined value.

According to yet another embodiment of the invention, there is provided a fuel injector control device for an outboard motor with a fuel-injected engine comprising: means for controlling a fuel injector, a first means for detecting at least one of a speed of the engine, a throttle setting of the engine, and a temperature of the engine, the first means for detecting having means for applying a first output signal to the means for controlling, the first output signal reflecting at least one of the speed of the engine, the throttle of the engine, and the temperature of the engine, a second means for detecting a speed of a vessel driven by the outboard motor, the second means for detecting having means for applying a second output signal to the means for controlling, the second output signal reflecting the speed of the vessel, a third means for detecting a trim angle of the outboard motor, the third means for detecting having means for applying a third output signal to the means for controlling, the third output signal reflecting the trim angle of the outboard motor, and the means for controlling the fuel injector being responsive to the first, second and third outputs.

According to a further embodiment of the invention, there is provided a method for controlling a fuel rate to a fuel injector of an outboard motor having an engine, comprising the steps of: detecting at least one of an engine speed, a throttle setting of the engine, and an engine temperature, detecting a speed of a vessel driven by the engine, detecting a trim angle of the engine, and adjusting the fuel rate to the fuel injector responsively to the results of the steps of detecting the trim angle, the vessel speed, and at least one of the engine speed, the throttle setting, and the engine temperature.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 7 is a sample correction map for adjusting fuel injection over a range of vessel speeds and trim angles.

FIG. 8(*b*) is a side view showing a second trim angle between the outboard motor and the vessel of FIG. 8(*a*).

DETAILED DESCRIPTION OF THE PREFERRED EMBODIMENTS

Figure 1:
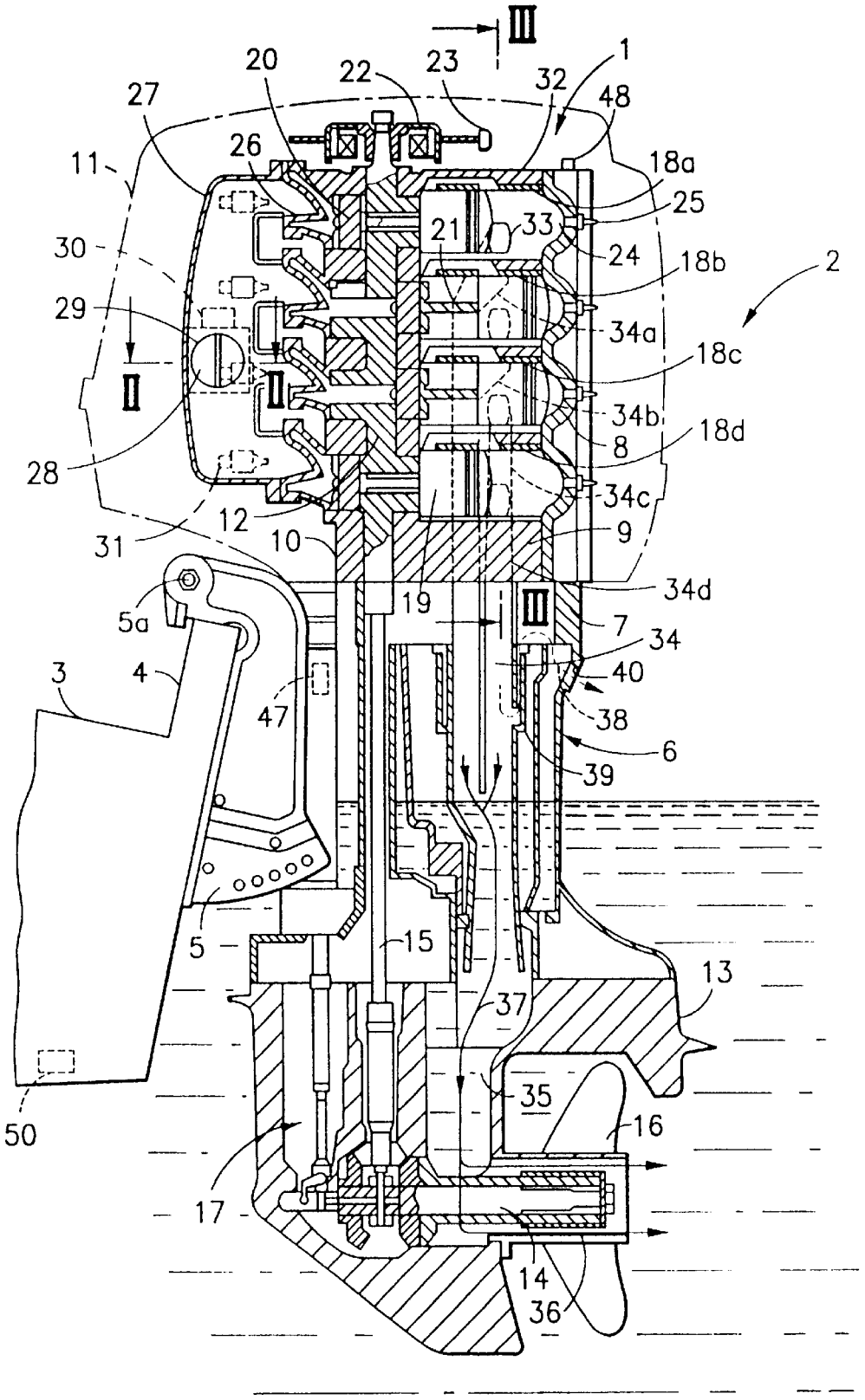
FIG. 1 is a side view, partially in section, of an outboard motor in which an embodiment of the present invention is used as fuel-injection control device.

Referring to FIG. 1, the present invention is implemented in an example of an outboard motor 2 equipped with a fuel-injected engine 1. Outboard motor 2 is mounted via a bracket 5 on a transom 4 of a boat 3.

Outboard motor 2 pivots on a shaft 5*a* of bracket 5 permitting a trim angle to vary in a range of approximately 20 degrees. Bracket 5 also allows outboard motor 2 to be tilted over a range of about 60 degrees upward beyond the full trim position. The trim angle and the tilt angle are controlled through oil pressure by a power trim and tilt device (hereinafter referred to as PTT not shown in the drawing). A PTT operations sensor 47, which detects the current trim and tilt positions, is disposed on the PTT.

Outboard device 2 has a drive shaft housing 6. An engine holder 7 is located on an upper portion of drive shaft housing 6. An engine 1 is located above engine holder 7. Engine 1 includes a cylinder head 8, a cylinder block 9, a crank case 10, and other conventional elements. Engine 1 is covered by an engine cover 11. A vertical crank shaft 12 rotates within crank case 10. Engine 1 could be, for example, a cold water two-cycle four-cylinder engine.

Below drive shaft housing 6 a gear case 13 rotatably supports a propeller shaft 14 driven by engine 1. Torque from engine 1 is transmitted through crank shaft 12 to drive shaft 15. Drive shaft 15 in turn rotates propeller shaft 14, causing a propeller 16, on a rear end portion of propeller shaft 14, to rotate. A shift mechanism 17 near a front end portion of propeller shaft 14, allows remote control of the direction of rotation of propeller shaft 14.

First, second, third and fourth cylinders 18*a*–18*d* are formed in cylinder block 9 of engine 1, arranged with first cylinder 18*a* at the top and fourth cylinder 18*d* at the bottom. Pistons 19, slidable in cylinders 18*a*–18*d*, are connected to crank pins 20 of crank shafts 12 via connecting rods 21. Thus reciprocating movements of pistons 19 are converted into a rotating motion of crank shaft 12.

A magnet 22 is disposed on an upper end of crank shaft 12. An engine rotation speed sensor 23 is fixedly mounted adjacent magnet 22. Engine rotation speed sensor 23 detects the rotation speed (the crank angle of crank shaft 12) of engine 1 by detecting the rotation of magnet 22. An engine temperature sensor 48 on engine 1 detects engine temperature. A cooling water temperature sensor (not shown in the drawing) detects the temperature of the engine cooling water. A spark plug 25 is held partly in a central portion of combustion chamber 24 by threads. Spark plug 25 is fired by an ignition coil 46 to which it is connected.

Figure 2:
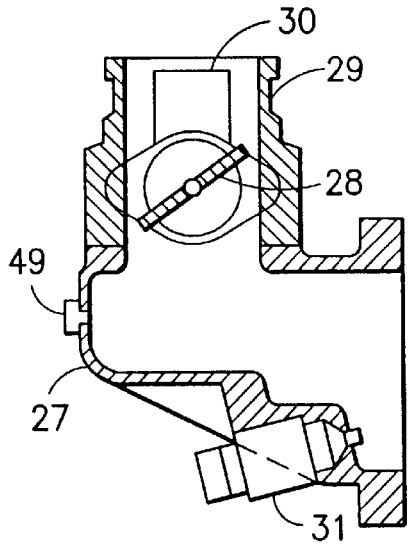
FIG. 2 is a cross-sectional view taken along line II—II line in FIG. 1.
Figure 3:
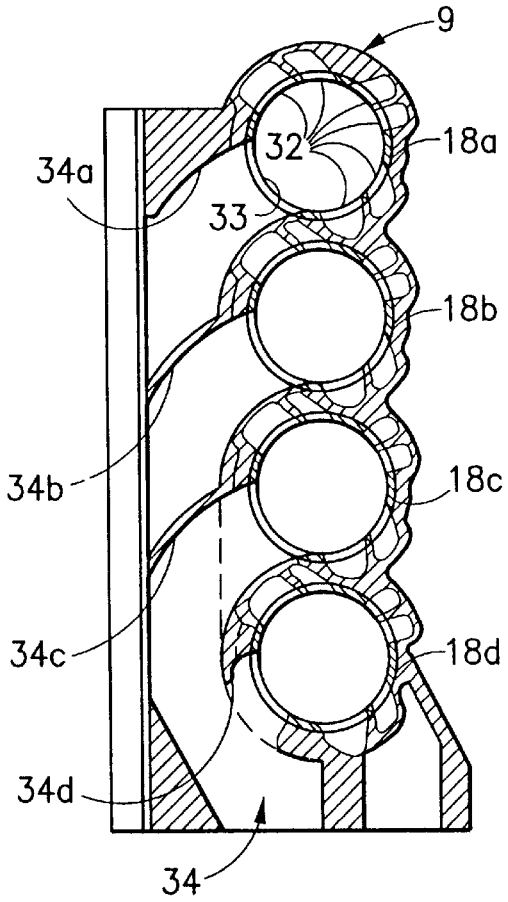
FIG. 3 is a cross-sectional view taken along line III—III line in FIG. 1.

Referring now also to FIGS. 2 and 3, there is one lead valve device 26, in crank case 10, for each cylinder 18*a*–18*d*. Upstream from lead valve devices 26 is a surge tank 27, and further upstream of surge tank 27 is an inlet pipe 29 with a throttle 28. A throttle setting sensor 30 which detects a setting of throttle 28 is positioned outside inlet pipe 29. An air cleaner (not shown in the drawings) is located further upstream of inlet pipe 29.

Fuel injectors 31 extend from outside surge tank 27 to its interior. In the present embodiment, there is one fuel injector 31 for each of cylinders 18*a*–18*d*. In alternative embodiments, there can be more or less. In the present embodiment, fuel injectors 31 are positioned to inject fuel upstream from lead valves 26. An inlet temperature detector 49 mounted in surge tank 27 detects inlet temperature at a crank chamber 10*a* located upstream within crank case 10. A suction pressure sensor (not shown in the drawings) detects suction pressure. An air volume sensor, an atmospheric pressure sensor, and other sensors are employed as taught by the prior art.

Lead valve devices 26 are connected downstream of crank chamber 10*a*. Scavenging ports 32 are formed in cylinder block 9. Scavenging ports 32 open along an inner perimeter surface of each of cylinders 18. An exhaust port 33 is also formed along the inner perimeter surface of cylinder 18. An exhaust path 34 extends from exhaust port 33.

A first exhaust path 34*a* of first cylinder 18*a* joins with a second exhaust path 34*b* from second cylinder 18*b* and extends to roughly the center of drive shaft housing 6. Similarly, a third exhaust path 34*c* of third cylinder 18*c* joins with a fourth exhaust path 34*d* of fourth cylinder 18*d* and extends to roughly the center of drive shaft housing 6, where they join with first and second exhaust paths 34*a* and 34*b*. The end of a combined exhaust path 34 opens up to an exhaust chamber 35 within gear case 13. Exhaust chamber 35 connects to a final exhaust path 36 formed around propeller shaft 14.

The lower half of drive shaft housing 6 and gear case 13 are submerged under water. When engine 1 is stopped, the lower half of the exhaust path 34, exhaust chamber 35, and final exhaust path 36 are filled with water. When engine 1 is operated, this water is pressed downward by the exhaust pressure from the exhaust gas. Referring to FIG. 1, exhaust gas is sent to the water as indicated by arrows 37 (shown as solid lines). When the engine is being idled or when the engine is being run at a slow speed, the exhaust pressure is not high enough to adequately push the water downward. In such cases, the exhaust gas is evacuated to the atmosphere through a secondary exhaust opening 40 via a bypass path 39 formed in drive shaft housing 6, as indicated by arrows 38 (shown as dotted lines).

Figure 4:
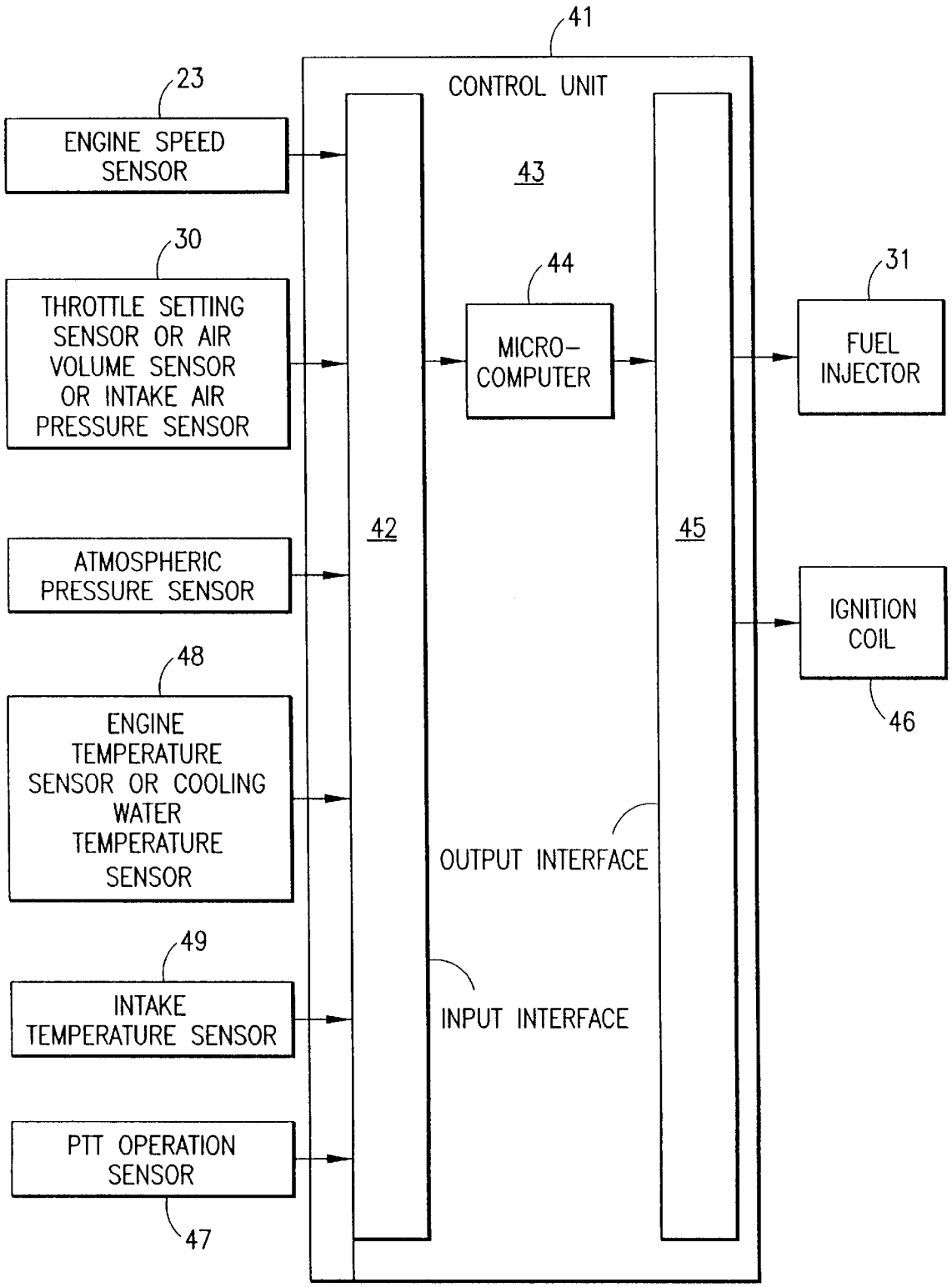
FIG. 4 is a block diagram of the fuel-injection control device.

The amount of injected fuel from fuel injector 31 is controlled by fuel injection control device 41. Referring to FIG. 4, fuel injector control device 41 detects the following with the corresponding sensors: rotation speed of engine 1, setting of throttle 28, suction pressure in surge tank 27, air volume, atmospheric pressure, engine temperature, cooling water temperature, temperature of intake air, and various conventional parameters. This data is passed to a control unit 43 via an input interface 42 to which signals are applied. A microcomputer 44 within control unit 43 calculates a suction volume based on the input data. After performing various corrections, the amount of fuel to be injected and the ignition timing is calculated. This is then output to fuel injector 31 and ignition coil 46 via an output interface 45.

Referring again to FIG. 1, outboard motor 2 can be pivoted up and down (trim and tilt) by the PTT. As trim applied to the outboard motor 2 is changed, the load on engine 1 varies. This variation in the load can result in varying rotation speeds for the engine even if the throttle setting is fixed. In turn, this variation in rotation speed can change engine output. Thus, it is possible to use data from PTT operation sensor 47 on the PTT in the calculations for the amount of fuel injection. A vessel speed sensor 50 is disposed on boat 3. Thus, it is possible to use data from vessel speed sensor 50 in the calculations for the amount of fuel injection.

As previously described, the trim angle of outboard device 2 relative to boat 3 is large when the vessel speed is high, and is small when the vessel speed is low. Since final exhaust path 36 of engine 1 of outboard device 2 is opens to the water, the back pressure for exhaust path 34 can change according to vessel speed and trim angle. In a two-cycle engine, changes in the back pressure can cause the air intake volume (suction volume) to change. As a result, omitting trim angle and vessel speed from calculations for the amount of fuel injection can lead to deteriorated air-to-fuel ratios.

Figure 5:
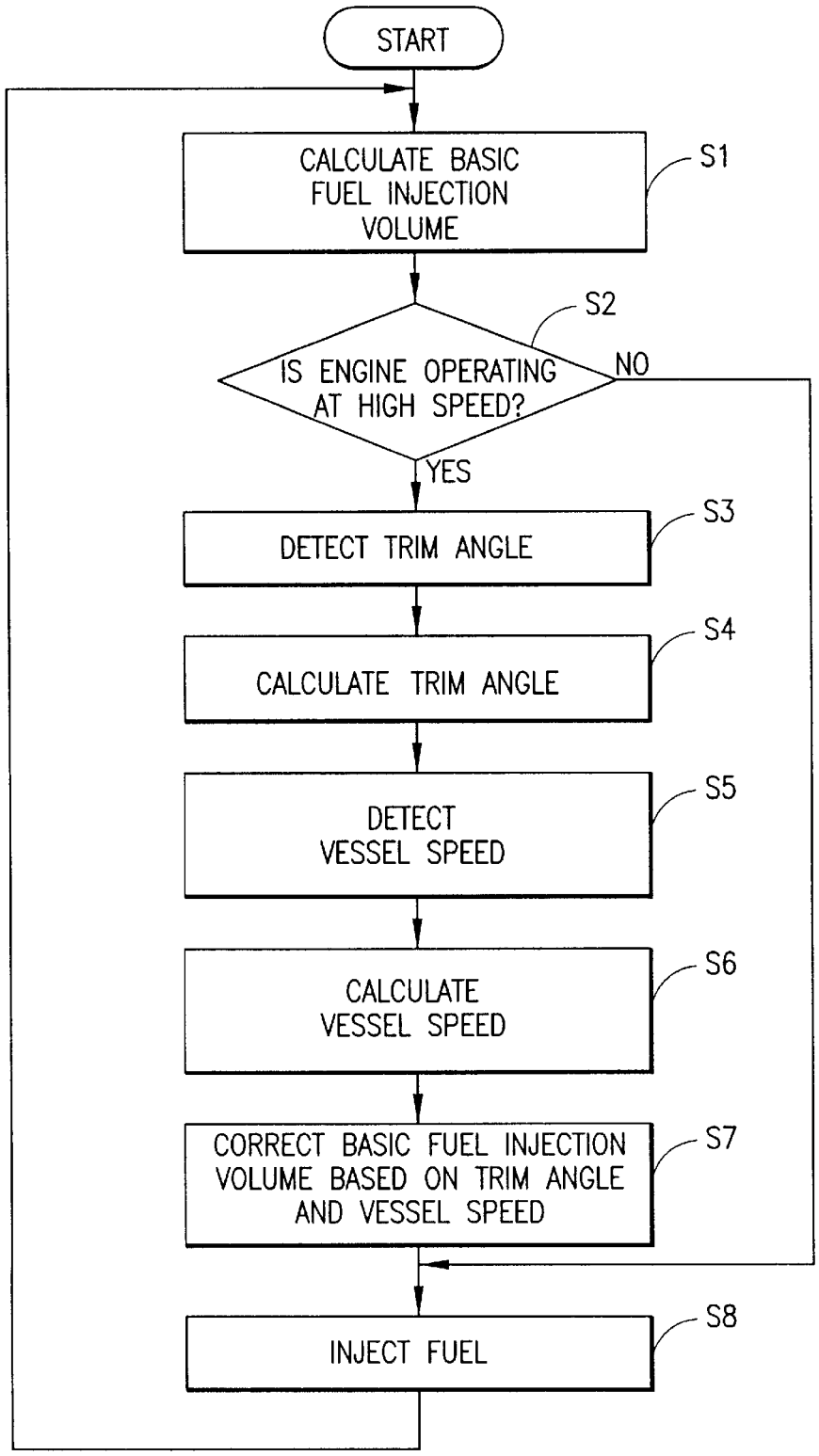
FIG. 5 is a flow chart showing an operation routine for controlling fuel injection.

Referring to FIG. 5, a main routine is executed during operation of engine 1. Microcomputer 44 uses the data described above to calculate an intake volume, and, after performing various corrections, calculates the basic fuel injection volume in step S1.

Next, the speed of engine 1 is detected and evaluated to determine whether engine 1 is being operated at a high speed in step S2. If engine 1 is not being operated at a high speed, the basic fuel injection volume, calculated in step S1, is injected into cylinder 18 of engine 1 in step S8.

If the engine is being operated at a high speed, the trim angle is detected in step S3 and calculated in step S4. Next, the vessel speed is detected in step S5 and calculated in step S6. Microcomputer 44 then uses the calculated trim angle and calculated vessel speed values to determine an appropriate correction value for the fuel injection volume in step S7. The fuel injection volume, calculated in step S7, is then injected into cylinder 18 of engine 1 in step S8.

Figure 6:
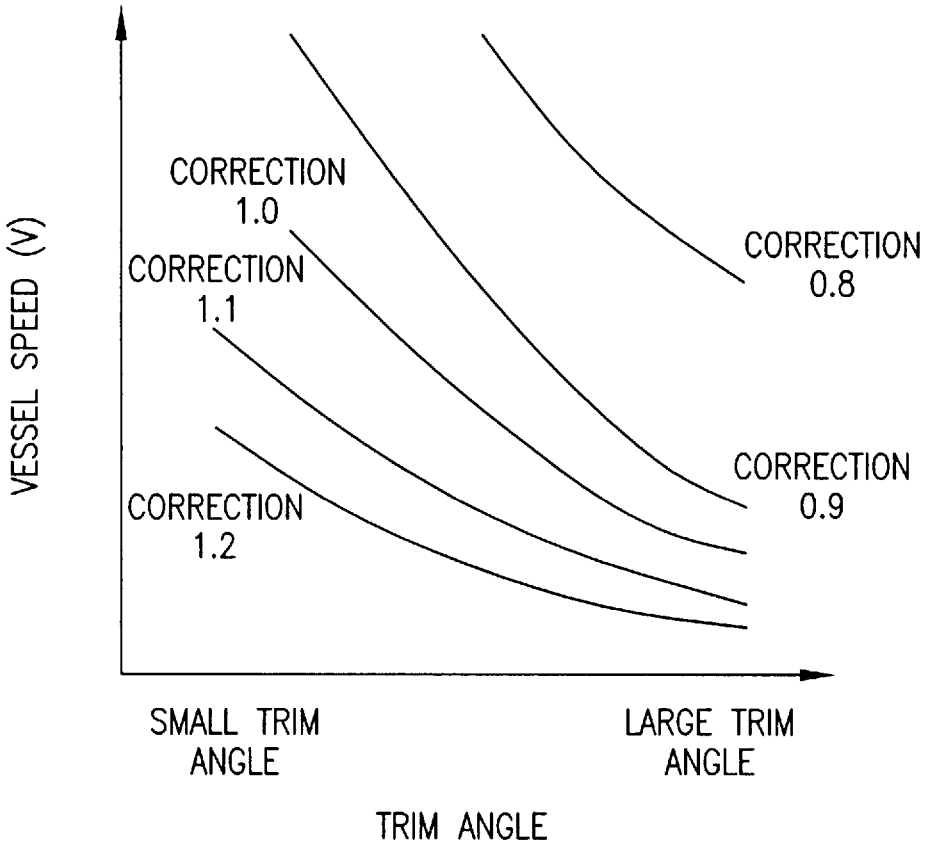
FIG. 6 is a graph showing sample correction values for adjusting fuel injection over a range of vessel speeds and trim angles.
Figure 8A:
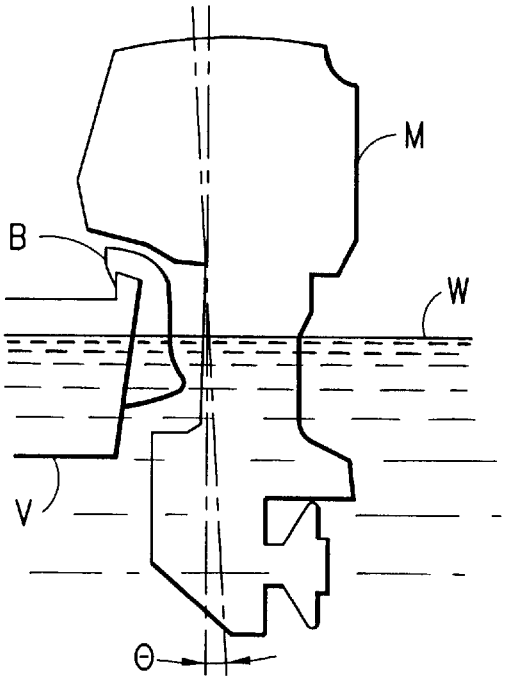
FIG. 8(*a*) is a side view showing a first trim angle between a outboard motor and a vessel.
Figure 8B:
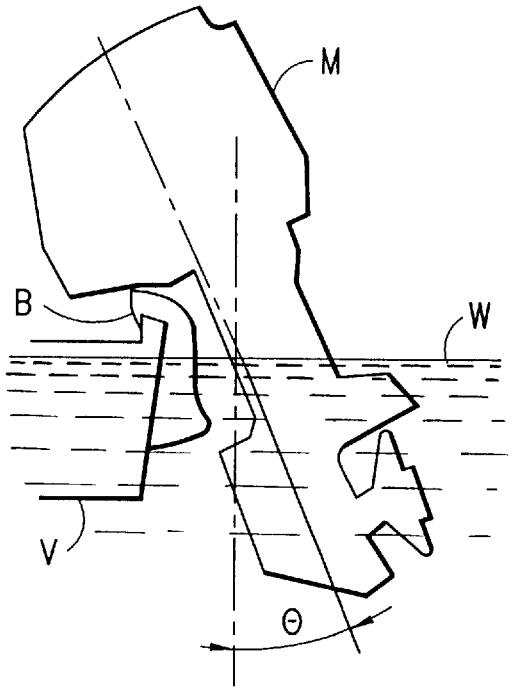

Referring to FIG. 6, a series of constant correction curves are shown as functions of vessel speed and trim angles. As shown, correction value varies with vessel speed and trim angle.

Referring to FIG. 7, a sample correction map, obtained from the curves in FIG. 6, is used to determine correction values. For example, correction value C22 would be chosen if the calculated vessel speed was V2 and the calculated trim angle was T2.

As described above, when engine 1 is being operated at high-speeds, the vessel speed and the trim angle are detected and calculated. The calculated trim angle and the calculated vessel speed, along with calculated values of the engine rotation speed, the engine temperature, the intake temperature, and the like, are used to determine a correction value for the amount of fuel injection. Thus, even if the back flow pressure in exhaust path 34 changes due to changes in the trim angle or the vessel speed, an accurate correction value will be determined for an amount of fuel injection providing optimal air-to-fuel ratio. Furthermore, an expensive exhaust pressure detecting means is not required in exhaust path 34.

Referring again to FIG. 4, there is no need for special detectors for fuel injection control device control device 41. The correction mechanism described above can be implemented using existing sensors by appropriately programming control microcomputer 44. Thus, there is little added cost. Also, since no changes in layout are needed for attaching new detecting means to engine 1, increases in cost are avoided.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

In order to obtain the correction values described above, this embodiment used engine rotation speed, engine temperature, and intake temperature. However, it would also be possible to detect the setting of throttle 28, the boost pressure of engine 1, the temperature of the cooling water for engine 1, the intake air volume, and the like.

As described above, the present invention relates to a fuel-injection control device for outboard motors having a fuel-injection two-cycle engine. The rotation speed of the engine, the engine temperature, the intake temperature and the like are detected and a basic fuel injection volume is determined. Fuel is sent to each of the cylinders. When the engine is being operated at a high speed, the trim angle and the vessel speed are detected. Based on the values calculated for trim angle and vessel speed, the basic fuel injection volume is corrected. Thus, during high-speed operation of the engine, an optimal air-to-fuel ratio is obtained without detecting the exhaust pressure of the engine.

What is claimed is:

1. A fuel injection control device for an outboard motor with a fuel-injected engine comprising:

a control unit;

an engine speed detector to detect an engine speed of said motor, said engine speed detector being connected to apply a first output reflecting said engine speed of said motor to said control unit;

a trim angle detector to detect a trim angle of said motor, said trim angle detector being connected to apply a second output reflecting said trim angle to said control unit;

a vessel speed detector to detect a speed of a vessel driven by said motor, said vessel speed detector being connected to apply a third output reflecting said speed of said vessel to said control unit; and said control unit being programmed to adjust a fuel injection volume flow rate supplied to said fuel-injected engine responsively to said first, second, and third outputs.

2. A device as in claim 1, wherein said control unit is programmed to store fuel injection volume data in a memory;

said control unit is programmed to select one of said fuel injection volume data responsively to said first, second, and third outputs; and said control unit is programmed to adjust said fuel injection volume flow rate supplied to said engine responsively to said selected fuel injection volume data.

3. A device as in claim 2, wherein said fuel-injected engine is a two-cycle engine.

4. A device as in claim 3, wherein said control unit is further programmed to adjust said fuel injection volume flow rate supplied to said fuel-injected engine responsive to said second and third outputs only if said first output reflects that said motor is operating at an engine speed above a predetermined value.

5. A device as in claim 2, wherein said control unit is further programmed to adjust said fuel injection volume flow rate responsive to said second and third outputs only if said first output reflects that said motor is operating at an engine speed above a predetermined value.

6. A device as in claim 1, wherein said control unit is further programmed to adjust said fuel injection volume flow rate responsive to said second and third outputs only if said first output reflects that said motor is operating at an engine speed above a predetermined value.

7. A device as in claim 6, wherein said fuel-injected engine is a two-cycle engine.

8. A device as in claim 1, wherein said fuel-injected engine is a two-cycle engine.

9. A fuel injector control device for an outboard motor with a fuel-injected engine comprising:

means for controlling a fuel injector;

a first means for detecting at least one of a speed of said engine, a throttle setting of said engine, and a temperature of said engine;

said first means for detecting having means for applying a first output signal to said means for controlling, said first output signal reflecting at least one of said speed of said engine, said throttle of said engine, and said temperature of said engine;

a second means for detecting a speed of a vessel driven by said outboard motor;

said second means for detecting having means for applying a second output signal to said means for controlling, said second output signal reflecting said speed of said vessel;

a third means for detecting a trim angle of said outboard motor;

said third means for detecting having means for applying a third output signal to said means for controlling, said third output signal reflecting said trim angle of said outboard motor; and said means for controlling said fuel injector being responsive to said first, second and third outputs.

10. A method for controlling a fuel rate to a fuel injector of an outboard motor having an engine, comprising the steps of:

detecting at least one of an engine speed, a throttle setting of said engine, and an engine temperature;

detecting a speed of a vessel driven by said engine;

detecting a trim angle of said engine; and adjusting said fuel rate to said fuel injector responsively to results of said steps of detecting said trim angle, said vessel speed, and said at least one of said engine speed, said throttle setting, and said engine temperature.

* * * * *